United States Patent [19]

van der Wilk

[11] Patent Number: 4,950,949

[45] Date of Patent: Aug. 21, 1990

[54] COLOR DISPLAY TUBE HAVING ASYMMETRIC DEFLECTION ELECTRODES

[75] Inventor: Ronald van der Wilk, Eindhoven, Netherlands

[73] Assignee: U.S. Philips Corporation, New York, N.Y.

[21] Appl. No.: 255,188

[22] Filed: Oct. 7, 1988

[30] Foreign Application Priority Data

Oct. 9, 1987 [NL] Netherlands ..... 8702400

[51] Int. Cl.[5] ..... H01J 29/74; H01J 63/02

[52] U.S. Cl. ..... 313/495; 313/422

[58] Field of Search ..... 313/422, 585, 491, 495

[56] References Cited

U.S. PATENT DOCUMENTS 4,404,493 9/1983 Nonomura et al. ..... 313/422

4,672,272 6/1987 Littwin ..... 313/422 X 4,719,388 1/1988 Oess ..... 313/422 X 4,721,880 1/1988 Mansell et al. ..... 313/422

*Primary Examiner*—Palmer C. DeMeo

*Attorney, Agent, or Firm*—John C. Fox

[57] ABSTRACT

A color display tube which comprises a display window and a phosphor pattern provided on the display window, an emission system for producing a pattern of juxtaposed rows of electron beams correlated with the phosphor pattern, an array of strip-shaped deflection electrodes situated between the emission system and the display screen for deflecting electron beams, each deflection electrode extending between adjacent rows of the emission pattern, alternate deflection electrodes being a commonly connected first group, and the remaining deflection electrodes being a commonly connected second group, is characterized in that the deflection electrodes extend asymmetrically with respect to the rows of electron beams.

6 Claims, 5 Drawing Sheets

COLOR DISPLAY TUBE HAVING ASYMMETRIC DEFLECTION ELECTRODES

BACKGROUND OF THE INVENTION

The invention relates to a colour display tube which comprises a display window, a system for emitting an emission pattern of juxtaposed rows of electron beams, a deflection system between the emission system and the display window for deflecting the electron beams, comprising deflection electrodes extending between adjacent rows of the emission pattern, and a phosphor pattern provided on the display window and correlated with the emission pattern.

A colour display tube of the type described in the opening paragraph is known from U.S. Pat. No. 4,404,493. In this Specification a colour display tube is described which comprises a number of parallel wire cathodes in a vacuum envelope. By selectivity switching on and off the wire electrodes a line of the picture can be built up. The emission system further comprises, a pair of parallel plate electrodes situated in front of the wire cathodes and provided with rows of apertures aligned with the wire cathodes. A system of flat strip-shaped electrodes extending transversely to the wire cathodes are present between the plate electrodes. The width of these electrodes corresponds approximately to the distance between adjacent apertures in a plate electrode. The strip-shaped electrodes are also provided with apertures aligned with the wire cathodes. The three electrodes constitute an array of aligned triplets of apertures consisting of one aperture in one of the plate electrodes, one aperture in a strip electrode and one aperture in the other plate electrode. During operation, this emission system emits electron beams in an emission pattern of juxtaposed rows, in this example parallel rows. Potential differences between the plate electrodes and the strip-shaped electrodes are controlled as a function of time in cooperation with the selective switching on and off of the wire cathodes so that an electron beam is emitted selectively in a number of points of a row. An array of parallel strip-shaped deflection electrodes are present between the emission system and the display window, alternate ones being a first group of commonlhy connected electrodes, and the remaining ones being second commonly connected electrodes. A phosphor pattern built up from sub-patterns in the colours red, green and blue is present on the display window. The phosphor pattern is correlated with the emission pattern. By applying potential differences between the groups of deflection electrodes, the electron beams are deflected towards the sub-patterns. As a result of this it is possible to construct a colour picture.

A disadvantage of the known colour display tube is that very high requirements are imposed upon the correlation between the emission pattern and the phosphor pattern. Since the pattern comprises juxtaposed rows, the phosphor pattern generally comprises juxtaposed triplets of rows or lines. The phosphor pattern may be unintentionally shifted with respect to a desired position during manufacture of the display tube. In the known construction it is not possible to correct the results of a shift transversely to the rows of the phosphor pattern in a simple manner.

OBJECTS AND SUMMARY OF THE INVENTION

It is an object of the invention to provide a colour display tube of the type described in which the results of shifts transversely to the rows of the position with respect to a desired phosphor pattern can be corrected in a simple manner.

This object is achieved by means of a colour dispplay tube of the type mentioned which is characterized according to the invention in that each deflection electrode pattern extends asymmetrically with respect to adjacent rows of the emission pattern.

It is then possible, by varying the voltages at the deflection electrodes, in a simple manner to deflect electron beams transversely to the rows and to improve the correlation between the emission pattern and the phosphor pattern.

The deflection electrodes operate as electron optical lenses for the electron beams. Preferably, all electron beams are focussed to the same extent as much as possible. Hence, a preferred embodiment of the invention is characterized in that the deflection electrodes are situated in one plane, whereby variations in lens strength and hence in the focussing action of the deflection electrodes are restricted.

Another embodiment of the invention is characterized in that the array of deflection electrodes are situated on a single plate-shaped insulating support. The deflection electrodes and the support constitute one rigid assembly. This simplifies manipulation of the deflection electrodes and reduces the possibility of undesired deviations in the mutual distance between the deflection electrodes.

Still a further embodiment is characterized in that adjacent deflection electrodes are present at different distances to the display screen and that adjacent deflection electrodes differ in cross-section.

It may be necessary or desirable for structural reasons that the distance between adjacent deflection electrodes and the display screen differs, for example, in that they are present on opposite sides of an insulating support. For example, the possiblity of undesired electric contact between the deflection electrodes is then reduced. By causing the deflection electrodes to differ in cross-section it is possible to reduce differences in electron optical aberrations.

For example, by providing the group of deflection electrodes which is nearest to the display screen with a smaller cross-section than that of the other deflection electrode group.

This is a simple manner of reducing differences in electron optical properties.

BRIEF DESCRIPTION OF THE DRAWINGS

A few embodiments of the invention will now be described in greater detail with reference to the drawing, in which.

The Figures are diagrammatic and not drawn to scale.

DESCRIPTION OF THE PREFERRED EMBODIMENT

Figure 1:
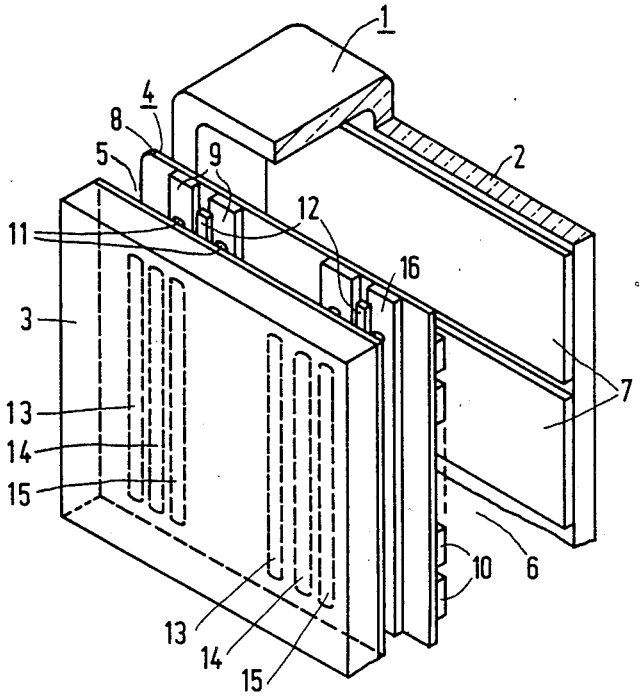
FIG. 1 is a diagrammatic and partly cutaway perspective view of a colour display tube according to the invention.

FIG. 1 is a perpsective view of a colour, partly cut away colour display tube according to the invention. Comprising in a gas-filled sealed envelope 1, a rear wall 2, a display window 3 and a selection electrode system 4. All these parts extend in substantially parallel planes. The interior of the envelope 1 is divided into a deflection space 5 and a gas discharge space 6 by the system 4 of selection electrodes. The front of the rear wall 2 comprises a number of plate-shaped cathodes 7. The selection electrode system 4 is constructed from an insulating support 8 which comprises on its front and rear sides a number of vertical electrodes 9 and a number of horizontal electrodes 10, respectively. The support 8 and the electrodes 9 and 10 comprise triplets of apertures which are situated on one line and which together define electron beam channels 11. These electron beam channels 11 are arranged in a number of vertical parallel rows. A line of the picture is built up by successively bringing the horizontal electrodes 10 to a threshold voltage with respect to the cathodes 7 at which a plasma discharge takes place between said electrode 10 and the cathode 7. The strength of the electron beam which enters the deflection space 5 through the electron beam channels 11 is modulated by the potential differences between the vertical electrodes 9 and the horizontal electrodes 10. Selection electrode system 4 and the plate-shaped cathodes 7 in this example form the emission system for emitting a pattern of electron beams. The emission system shown should not be considered to be restrictive to the invention. Other examples of emmision systems which emits a suitable pattern of electron beams are the one already mentioned in U.S. Pat. No. 4,404,493, and a system comprising a wire-shaped cathode and a grid, which generate an electron cloud, described in European Patent Specification EP 0 213 839. It is also to be understood that a row of electron beams means herein a number of electron beams which are arranged on a curve; as well as a straight line.

The colour display tube also comprises deflection electrodes 12 which extend asymmetrically between the vertical rows. The electron beams passing through the electron beam channels 11 into the deflection space 5 are deflected by said deflection electrodes 12 towards a recurring phosphor pattern of red, green and blue phosphors which is provided on the display screen 3 and is correlated with the pattern of the electron beams. In this example said pattern consists of triplets of lines 13, 14 and 15. As a result of this it is possible to build up a colour picture.

Figure 2:
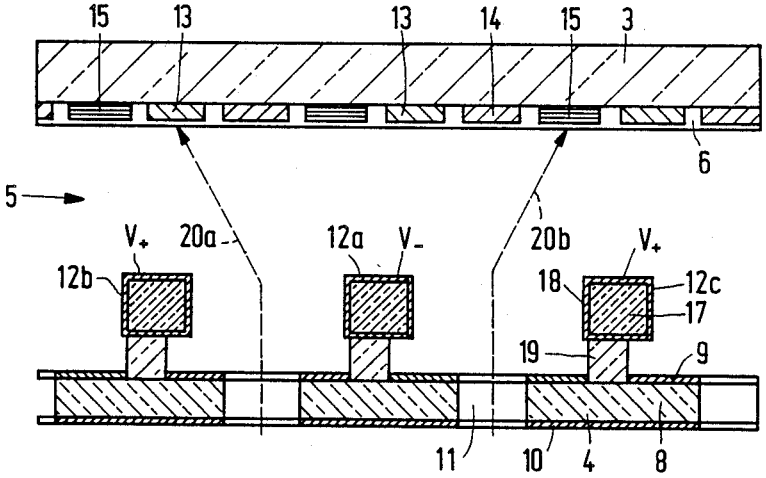
FIG. 2 is a sectional view of a detail of one embodiment of a colour display tube according to the invention, which detail shows the deflection electrodes.

FIG. 2 is a sectional view of the selection electrode system 4, the deflection electrodes 12 and the display window 3. The display window 3 comprises on its inside a recurring pattern of red (13), green (14) and blue (15) phosphors, respectively, and a conductive layer (16). Deflection electrodes 12, in this example consisting of insulated supports 17 having a conductive outer layer 18 are separated from selection electrode system 4 by insulating spacers 19. The way of separation shown here between the deflection electrodes 12 and the selection electrode system 4 should not be considered restrictive. The deflection electrodes 12 may be, for example, arrayed on a single insulating plate-shaped support to form one rigid assembly which is separated, for example, in a few points, by spacers, from the selection electrode system or which is connected to the side wall of the envelope 1 in a self-supporting manner, an appropriate distance. All deflection electrodes are generally present on one side of the plate-shaped insulating support, but may be provided on the support in different ways. It is possible, for example, to place one group of the deflection electrodes on one side of the insulating support and the other group on the other side. This latter configuration reduces the possibility of undesired electric contact between the deflection electrodes.

The operation of deflection electrodes 12 will be described in greater detail with reference to FIG. 2. The central deflection electrode 12*a* in this example is at a negative potential $V_-$, the outer deflection electrodes 12*b* and 12*c* are at a positive potential $V_+$. Electron beam 20*a* in this example is deflected to the left towards a red phosphor 13, electron beam 20*b* to a blue phosphor 15. If the potential at all deflection electrodes is identical, electron beams 20*a* and 20*b* are not defelcted and impinge on the green phosphor 14. If the central deflection electrode 12*a* is at a positive potential $V_+$ and the outer deflection electrodes 12*b* and 12*c* are at a negative potential $V_-$, electron beam 20*a* is deflected to the right, to a blue phosphor 15, and electron beam 20*b* is deflected to the left, to a red phosphor 13.

Figure 3A:
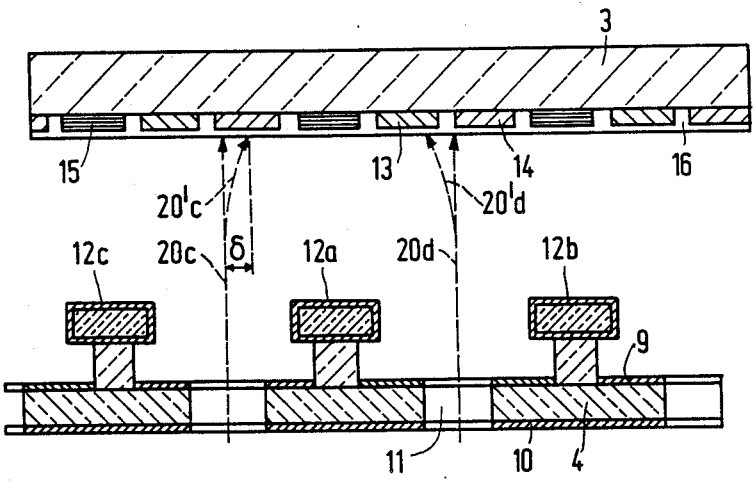
FIG.3a PRIOR ART
FIG. 3*a* is a sectional view of a detail of a known colour display tube, which detail shows the deflection electrodes.
Figure 3B:
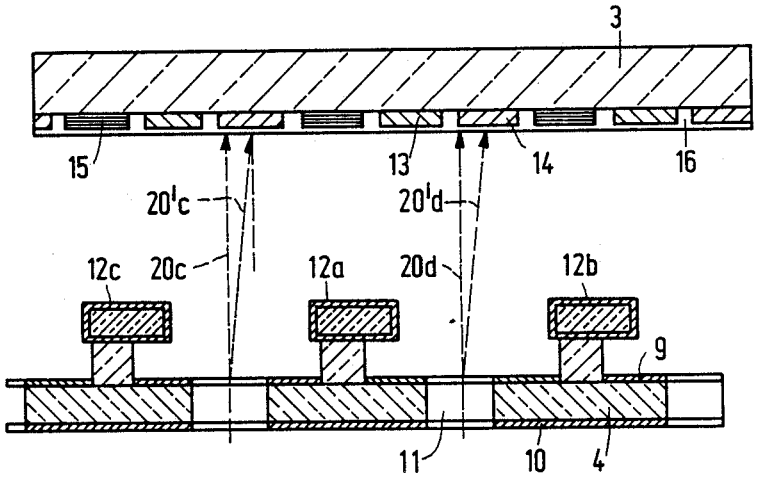
FIG. 3*b* is a sectional view of a detail of another embodiment of a colour display tube according to the invention, which detail shows the deflection electrodes.

FIGS. 3*a* and 3*b* show the advantageous difference between the invention and the prior art, FIG. 3*a* showing the prior art and FIG. 3*b* showing the invention. FIG. 3*a* differs from FIG. 2 in that deflection electrodes 12 now extend symmetrically with respect to the electron beam channels 11 and in that the phosphor pattern is shifted over a distance $\delta$ from its desired position. It can be seen as follows that the results of that shift cannot simply be corrected. If no potential differences occur between the deflection electrodes, undeflected electron beams 20*c* and 20*d* impinge on the edge of the green phosphor 14. The deviation can be corrected for electron beam 20*c* by a small positive potential at the central deflection electrode 12*a* and a small negative potential at the outer deflection electrodes 12*b* and 12*c*, so that electron beam 20*c* is deflected to the right over a distance $\delta$. However, electron beam 20*d* is then deflected to the left over a distance $\delta$ and impinges on the red phosphor 13. A common change of the potentials at the deflection electrodes 12*a*, *b* and *c* has no influence on the paths followed by electron beams 20*c* and 20*d*. It is not possible for this construction to deflect both electron beams 20*c* and 20*d* in the same direction by variation of the potentials at the deflection electrodes.

The deflection electrodes 12*a*, 12*b* and 12*c* in FIG. 3*b* according to the invention extend asymmetrically with respect to the electron beam channels 11. It is now possible to deflect both electron beam 20*c* and electron beam 20*d* to the same side in parallel by varying the voltages at the deflection electrodes 12 in common so that unintentional shifts of the phosphor patterns transversely to the rows can be compensated for. By a negative potential difference $V_1$ between the deflection electrode 12 and electrodes 9, both electron beams 20*c* and 20*d* in this example are deflected towards the same side. As a result of this both beams impinge on green phosphors. By superposition of $V_1$, in common on all deflection electrodes 12 and $V_-$ and $V_+$ at the groups of deflection electrodes, the deflections of electron beams to the red and blue phosphors are to a first approximation also corrected over the same distance and in the same direction. Consequently shifts of the phosphor pattern transversely to the rows can simply be compensated for by the invention.

Figure 4A:
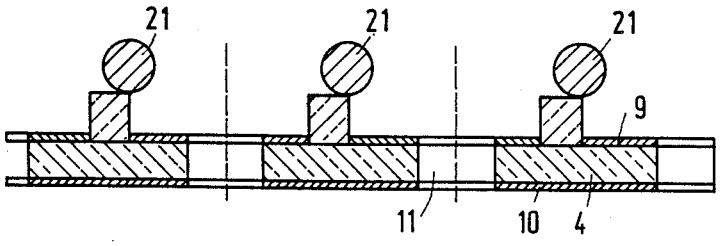
FIGS. 4*a* through *d* are view similar to FIGS. 2 and 3 showing further examples of colour display tubes according to the invention.
Figure 4B:
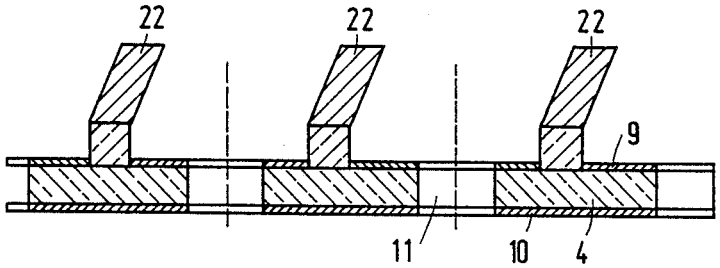
Figure 4C:
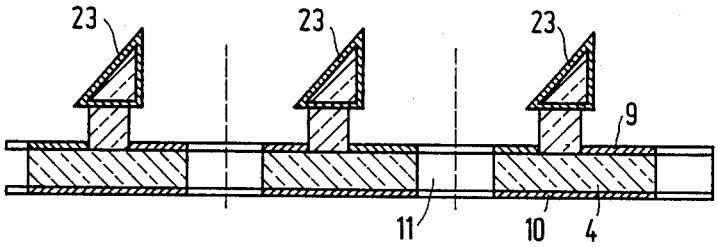
Figure 4D:
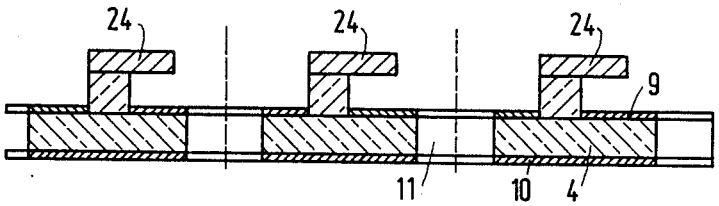

The constructions shown in FIGS. 2 and 3 should not be considered as being restrictive. FIG. 4, shows a few further embodiments of construction suitable for a colour display tube according to the invention. FIG. 4*a* shows deflection electrodes 21 manufactured from solid conductive wires. These deflection electrodes 21 extend asymmetrically with respect to the electron beam channels 11. FIG. 4*b* shows plate-shaped deflection electrodes 22 which extends at an angle and asymmetrically with respect to eletron beam channels 11. FIG. 4*c* shows deflection electrodes 23 having a triangular cross-section. FIG. 4*d* shows plate-shaped deflection electrodes 24 extending in a plane parallel to electrodes 9.

Figure 5:
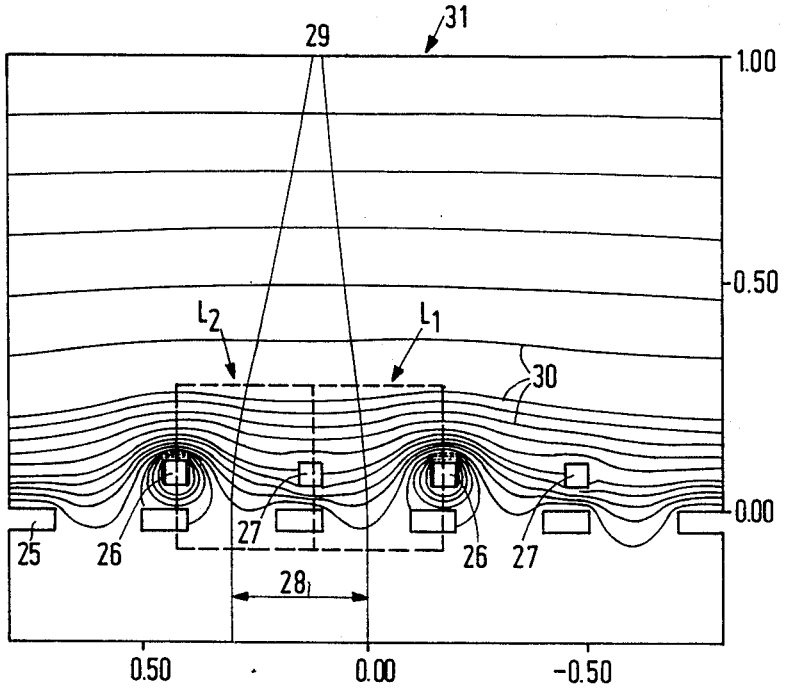
FIGS. 5 and 6 are sectional views of a detail of a colour display tube according to the invention showing diagrammatic representations of the electric field in the proximity of the deflection electrodes, wherein the deflection electrodes are situated in one plane and in two different planes, respectively.
Figure 6:
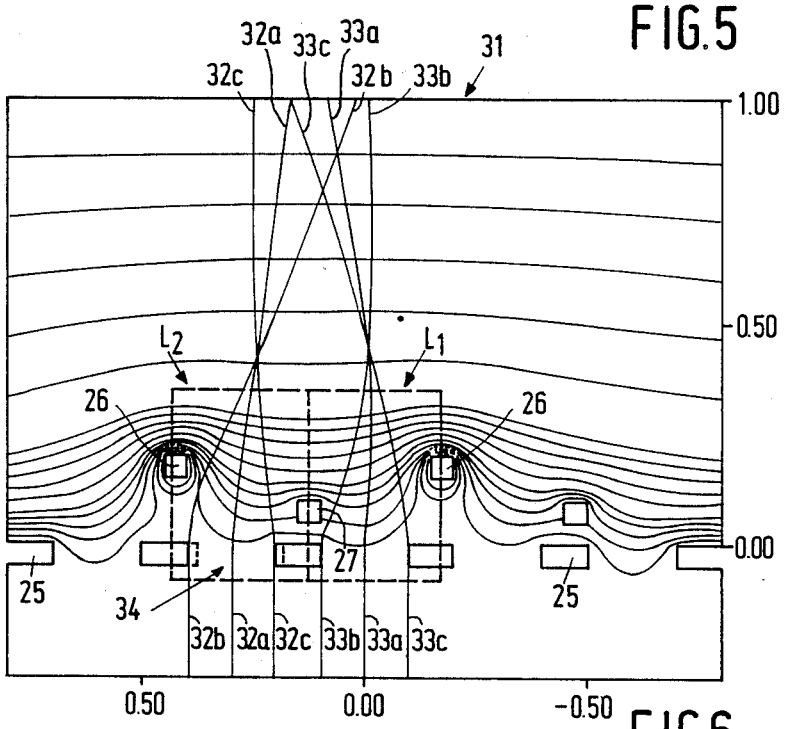

FIGS. 5 and 6 are sectional views of a detail of a colour display tube according to the invention and illustrating with equipotential lines the electric field in the proximity of the deflection electrodes, wherein in FIG. 5 the deflection electrodes are situated in one plane and in FIG. 6 the deflection electrodes are situated in two different planes.

The deflection electrodes 26 and 27 in FIG. 5 extend in one plane at a short distance from a last apertured electrode 25 of an emission system. The electrons are deflected to the points 29 on the display screen 31 by the electric field between said electrodes, a few equipotential lines 30 of which are shown in FIG. 5. In this example the electrodes 25, 26 and 27 are at potentials of 250, 0 and 500 Volt, respectively, and the display screen is at a potential of 4,000 Volt. Electron optical lenses are formed between the electrodes 25, 26 and 27 by the electric field. Two of the these lenses, $L_1$ and $L_2$, are shown in FIG. 5. The electron optical properties of these lenses are not identical as a result of the asymmetrical arrangement of the electrodes.

Figure 7:
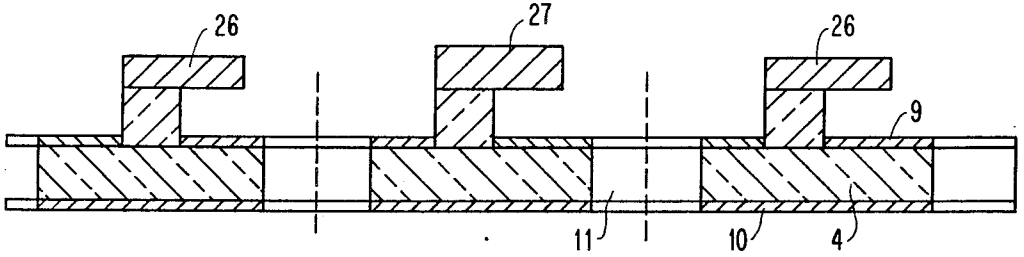
FIG. 7 is a sectional view similar to FIGS. 2–4 showing another embodiment of the display tube of the invention.

Electrodes 26 and 27 in FIG. 6 are situated in different planes; the distance between electrodes 26 and 25 is larger than the distance between the electrodes 27 and 25. Such a construction may occur, for example, if the electrodes 26 and 27 are provided on each side of a plate-shaped insulating support. The difference in electron optical properties between the lenses $L_1$ and $L_2$ in this Figure is larger than in FIG. 5 as calculations have demonstrated. The effect of the differences between the lenses $L_1$ and $L_2$ in electron optical properties is shown in FIG. 6 by the paths of the central and the outer electrons of electron beams 32 and 33. The central electrons of said beams are shown in FIG. 6 by 32*a* and 33*a*, respectively, the outer electrons by 32*b* and 32 c 33*b* and 33*c*, respectively. It will be obvious from the Figure that the target of electron beam 32 on the display screen 31 is larger than the target of the electron beam 33, in other words the beams 32 and 33 are focussed differently, the display errors for the two beams also differing. Calculations have demonstrated that for a construction as shown in FIG. 6 the differences in the displays of beams 32 and 33 are caused to a considerable extent by extra aberration in beam 32 which is in turn to a considerable extent by the outer electrons 32*b* being deflected very strongly in the immediate proximity of the farthest remote electrode 26. Various solutions to this problem are feasible. It is possible to shift aperture 34 through which beam 32 passes; this is shown in broken lines in the Figure. The outermost electrons of electron beam 32 then no longer come in the immediate proximity of electrode 26. The distance between adjacent rows is then unequal to the distance between adjacent deflection electrodes. A similar effect can be obtained by moving electrodes 26, in that case also the distance between adjacent rows is unequal to the distance between adjacent deflection electrodes. Another possibility is to make electrodes 26 smaller in cross-section than electrodes 27 as shown in FIG. 7 or generally give them a cross-sectional shape differing from electrodes 27 so that electron optical aberrations are reduced. By differences in such shape between adjacent deflection electrodes, differences in the electron optical properties and notably in the focussing, can be reduced.

The invention makes it possible to shift the phosphor pattern intentionally, for example, as is shown in FIG. 3*b*, so that deflected electron beams 20*c*′ and 20*d*′ extend substantially centrally between the deflection electrodes 12. As a result of this deflection of electron beams 20*c*′ and 20*d*′ aberrations are reduced.

It will be obvious that many variations are possible to those skilled in the art without departing from the scope of this invention.

What is claimed is:

1. A colour display tube which comprises in a sealed envelope a display window, a phosphor pattern provided on the display window, an emission system for producing an emission pattern of juxtaposed rows of electron beams correlated with the phosphor pattern, and an array of parallel, strip shaped deflection electrodes between the emission system and the display window for deflecting the electron beams, in which each deflection electrode extends between adjacent rows of electron beams of the emission pattern, alternate ones being a first group of commonly connected electrodes and the remaining ones being a second group of commonly connected electrodes, characterized in that the array of deflection electrodes extends asymmetrically with respect to the emission pattern.

2. A colour display tube as claimed in claim 1, in which the deflection electrodes are situated in one plane.

3. A colour display tube as claimed in claim 1, in which the deflection electrodes are situated on a plate-shaped support.

4. A colour display tube as claimed in claim 3, in whihc the first group of deflection electrodes is situated on one side and the second group is situated on the other side of the plate-shaped insulating support.

5. A colour display tube as claimed in claim 1, in which adjacent deflection electrodes are situated at varying distances to the display screen.

6. A colour display tube as claimed in claim 5, in which the cross-section of the group of deflection electrodes which is nearest to the display screen is smaller than that of the other deflection electrode group.

* * * * *